United States Patent [19]

Jacob et al.

[11] 3,962,954

[45] June 15, 1976

[54] SUPPLY APPARATUS FOR TWO RECEIVING MEANS HAVING A PRESSURE SUMMATION DEVICE

[75] Inventors: René F. Jacob, Le-Plessis-Belleville; Pierre C. Fillion, Nanteuil-le-Haudouin, both of France

[73] Assignee: Poclain, Le-Plessis-Belleville, France

[22] Filed: Feb. 3, 1975

[21] Appl. No.: 546,830

[30] Foreign Application Priority Data

Feb. 4, 1974 France ..... 74.03659

[52] U.S. Cl. ..... 91/412; 91/414; 137/115; 417/286; 417/300

[51] Int. Cl.[2] ..... F15B 11/16

[58] Field of Search ..... 417/216, 286; 137/115; 91/411 R, 412, 414, 461, 304; 60/428

[56] References Cited

UNITED STATES PATENTS

| | | | |
|---|---|---|---|
| 2,239,148 | 4/1941 | Ernst | 137/115 |
| 2,467,576 | 4/1949 | Zimmerman | 137/115 X |
| 2,659,206 | 11/1953 | Carlson | 91/411 R |
| 3,447,556 | 6/1969 | Howeth | 417/34 X |
| 3,716,308 | 2/1973 | Kobald | 417/428 X |
| 3,723,026 | 3/1973 | Soyland et al. | 417/216 X |

FOREIGN PATENTS OR APPLICATIONS

| | | | |
|---|---|---|---|
| 2,218,007 | 8/1974 | France | 91/412 |
| 2,138,527 | 1/1973 | France | 91/413 |
| 1,919,402 | 12/1969 | Germany | 91/414 |
| 1,528,476 | 8/1969 | Germany | 417/426 |

*Primary Examiner*—Carlton R. Croyle
*Assistant Examiner*—Edward Look
*Attorney, Agent, or Firm*—Mason, Fenwick & Lawrence

[57] ABSTRACT

The invention relates to a supply apparatus for two receiving means having a pressure summation device. A relief valve with a double control system is provided on a pipe shunted to the delivery pipe of the pump and has two control connections, a rod connecting the discharge member of the pressure summation device to the first of the said connections and a control pipe connecting that portion of the discharge pipe located between the connection of the latter to the delivery pipe and the relief valve to the second of the said connections.

The invention is applicable to the realization of a supply apparatus with a pressure transfer system.

4 Claims, 4 Drawing Figures

SUPPLY APPARATUS FOR TWO RECEIVING MEANS HAVING A PRESSURE SUMMATION DEVICE

BACKGROUND OF INVENTION

The present invention relates to an apparatus for supplying pressurized fluid to two receiving means with pressure transfer by means of a double control valve.

Apparatuses for supplying two receiving means equipped with a pressure transfer system are already known. Such an apparatus is for example described in French Publication No. 2,218,007 of Sept. 6, 1974.

Pressure transfer then takes place by using a first calibrated relief valve equipped with a single control system by the pressure of a fluid intermediate between the pressures of the supply fluids of the receiving means. To increase the mechanical safety and reliability of the supply apparatus a second calibrated valve is preferably used which prevents too great a pressure transfer taking place.

BRIEF SUMMARY OF INVENTION

The present invention proposes a new pressure transfer system involving the use of only a single calibrated relief valve of a special type which is equipped however with a double control system. Two applications thereof are defined.

The object of the first application is an apparatus for supplying pressurized fluid to two receiving means such as hydraulic motors constituted by two receiving means, a pressurized fluid source, a flow divider, a delivery pipe connecting the said fluid source to the inlet of the said flow divider, two main pipes whereby each of which is connected on the one hand to one of the receiving means and on the other to one of the two outlets of the flow divider, two auxiliary pipes whereof one connects one of the main pipes to one of the two inlets of a so-called pressure summation device, and the other connects the other main pipe to the other inlet of the said pressure summation device, a discharge pipe shunted in per se known manner to the delivery pipe and a calibrated relief valve positioned on the said discharge pipe.

This relief valve has a double control system and comprises two control connections whilst a link links the discharge member of the pressure summation device to a first of the said control connections and a control pipe connects that portion of the discharge pipe located between the connection of the latter to the delivery pipe and the relief valve to the second of the said control connections.

According to another application of the invention involving the same inventive principle as the first, the invention has for its object an apparatus for supplying pressurized fluid constituted by two pressurized fluid sources, two receiving means, two main pipes whereof one connects one of the fluid sources to one of the receiving means and the other connects the other fluid source to the other receiving means, a so-called pressure summation device equipped with two inlets and a discharge member, two auxiliary pipes whereof one connects one of the main pipes to one of the inlets of the pressure summation device and the other connects the other main pipe to the other inlet of the pressure summation device, at least one connecting pipe which connects the two main pipes, at least one shuttle valve arranged on at least one of the connecting pipes, a discharge pipe connected to the outlet of the said shuttle valve and a calibrated relief valve arranged on the said discharge pipe.

This relief valve has a double control system and comprises two control connections whilst a link links the discharge member of the pressure summation device to a first of the said control connections and a control pipe connects that portion of the discharge pipe located between the connection of the latter to the delivery pipe and the relief valve to the second of the said control connections.

In both applications the pressure summation device comprises an enclosure in two sections wherein is slidingly mounted a double piston having two portions of different cross-sections, whereby a first of these two portions slides in a first of the two sections and the second portion slides in the second section, whilst the two portions delimit in the said enclosure at least two separate chambers whereby each is provided with an orifice constituting the inlet, whereby the discharge member of the pressure summation device comprises the double piston itself and is mechanically coupled to the moving member of the relief valve.

Preferably, the moving member of the relief valve is integral with the double piston of the pressure summation device.

BRIEF DESCRIPTION OF THE DRAWINGS

Other and further objects of the present invention will be apparent from the following description and claims and are illustrated in the accompanying drawings which by way of illustration show preferred embodiments of the present invention and the principles thereof and what are considered to be the best modes contemplated for applying these principles. Other embodiments of the invention embodying the same or equivalent principles may be used and structural changes may be made as desired by those skilled in the art without departing from the present invention and the scope of the appended claims.

In the drawings show.

DETAILED DESCRIPTION OF THE PREFERRED EMBODIMENTS

Figure 1:
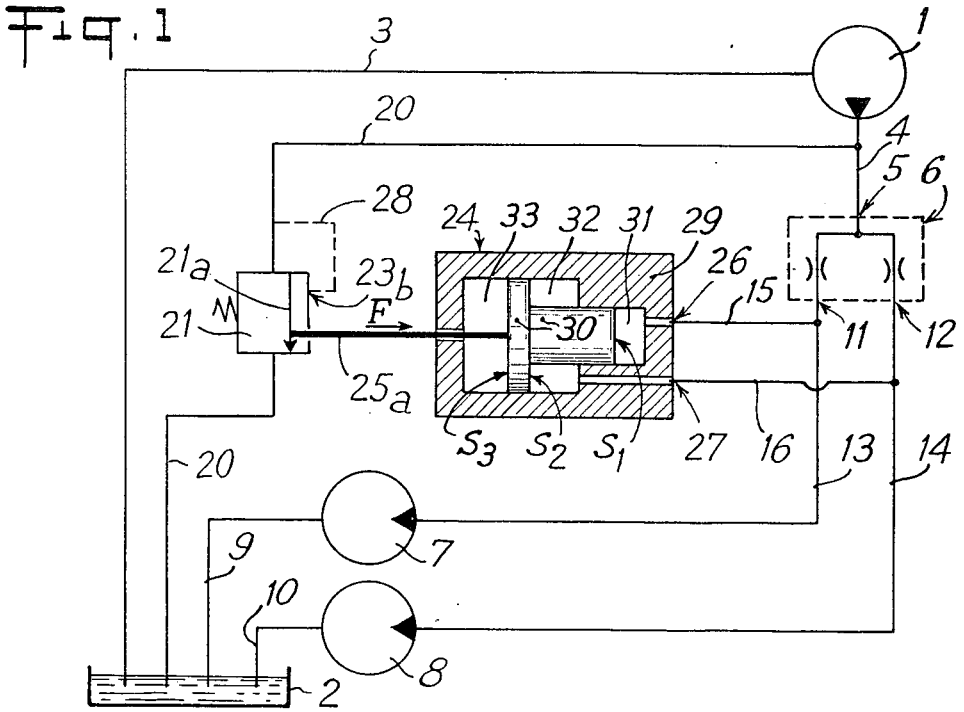
FIG. 1 schematically a supply apparatus comprising a single pump according to the invention.

The supply apparatus shown with reference to FIG. 1 comprises a pump 1 connected to a fluid tank 2 by its suction pipe 3 and to the inlet 5 of a flow divider 6 by its delivery pipe 4. The flow divider 6 is schematically represented by the parallel grouping of two mutually balanced constrictions and is a per se known means which can for example be of the type shown in FIG. 4 of French Specification No. 71 19 345.

Two hydraulic motors 7 and 8 are connected to tank 2 by pipes 9 and 10 and to outlets 11 and 12 of flow divider 6 by pipes 13 and 14.

A pipe 20 is shunted on delivery pipe 4 which it connects to tank 2. On pipe 20 is provided a calibrated relief valve 21 which is equipped with two control connections 25*a* and 23*b*. A detailed construction of this valve will be described hereinafter. A pipe 28 connects the connection 23*b* to that portion of pipe 20 located between delivery pipe 4 and relief valve 21. Finally, pipes 15 and 16 respectively connect pipes 13 and 14 with inlets 26 and 27 of pressure summation device 24.

The pressure summation device 24 comprises an enclosure 29 wherein is slidingly mounted a double piston 30 defining two chambers 31 and 32 which communicate respectively with inlets 26 and 27. The cross-sections $S_1$ and $S_2$ of the piston faces delimiting chambers 31 and 32 are smaller than the cross-section $S_3$ of the piston face delimiting discharge chamber 33. The following double equation is confirmed:

$$S_3 = 2S_1 = 2S_2$$

Finally, the control connection 25*a* comprises a rod which connects piston 30 to the moving member 21*a* of relief valve 21.

Figure 2:
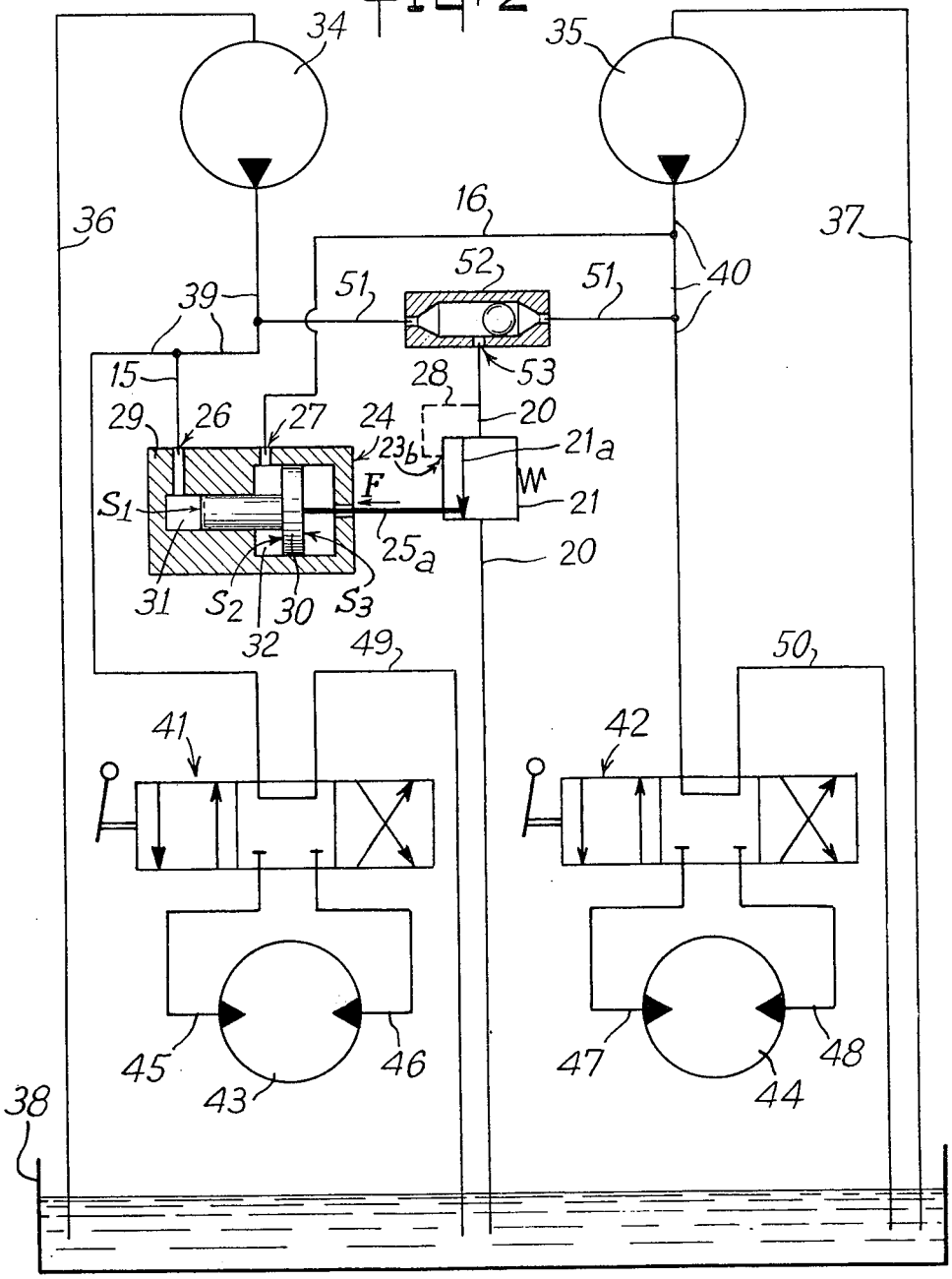
FIG. 2 schematically a supply apparatus comprising two separate pumps according to the invention.

The supply apparatus represented with reference to FIG. 2 comprises two pumps 34, 35 which are connected by their respective suction pipes 36, 37 to a fluid tank 38 and by their respective delivery pipes 39, 40 to two three-position valves 41, 42, whereby pipe 39 is connected to valve 41 and pipe 40 to valve 42.

Two reversible motors 43 and 44 are connected to the said two valves, motor 43 by pipes 45, 46 to valve 41 and motor 44 by pipes 47, 48 to valve 42. Moreover, pipe 49 connects valve 41 to tank 38 and pipe 50 connects valve 42 to tank 38.

In connection with the three positions of valves 41 and 42, the first position corresponds to connecting up pipes 39 and 45, 46 and 49, 40 and 47 and 48 and 50, the second position to connecting up pipes 39 and 49, and 40 and 50 and the sealing level with the valves of pipes 45, 46, 47 and 48 and third position to the connecting up of pipes 39 and 46, 45 and 49, 40 and 48, and 47 and 50.

A connecting pipe 51 connects the delivery pipes 39, 40, whilst a shuttle valve 52 is positioned on connecting pipe 51.

Certain of the components of the apparatus of FIG. 1 re-occur in connection with the apparatus of FIG. 2 and as they function in the same way are given the same reference numerals. These are more particularly relief valve 21 and pressure summation device 24. However, it should be noted that pipe 20 is connected upstream of relief valve 20 relative to tank 38 to the outlet 53 of shuttle valve 52.

Figure 3:
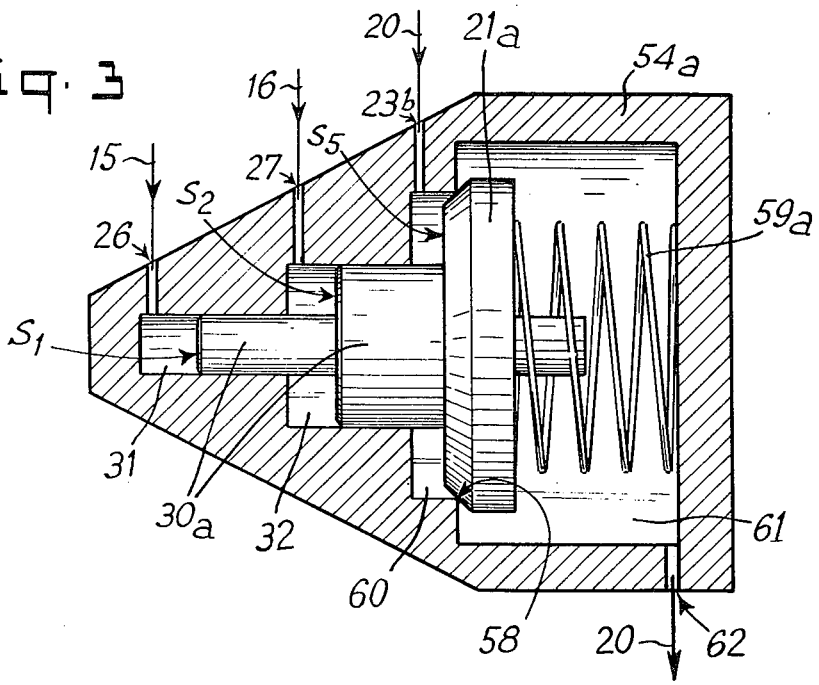
FIG. 3 is a section of a one-piece assembly including a calibrated relief valve with a double control system and a pressure summation device.

FIG. 3 shows a relief valve 21 which is identical to that of FIGS. 1 and 2 combined with the corresponding pressure summation device 24. Member 54*a* receives double piston 30*a* which constitutes a one-piece assembly with moving member 21*a* of the relief valve which is normally kept supported on its seat 58 by a spring 59*a*. When supported on its seat 58 moving member 21*a* defines with member 54*a* two chambers 60 and 61, whereby each of which is connected with one of the portions of pipe 20. Under the combined action of the pressure of the fluid contained in chambers 31, 32 and 60 (linked respectively with connections 26, 27 and 23*b*) on cross-sections $S_1$, $S_2$ and $S_5$ of piston 30*a* and of moving member 21*a*, counter to the action of spring 59, moving member 21*a* is disengaged from seat 58 which links chambers 60 and 61 and fluid entering via connection 23*b* is caused to flow towards outlet 62. The connection between moving member 21*a* and piston 30*a* is eliminated, whereby these two members are now directly coupled together representing an interesting and very important simplification.

Figure 4:
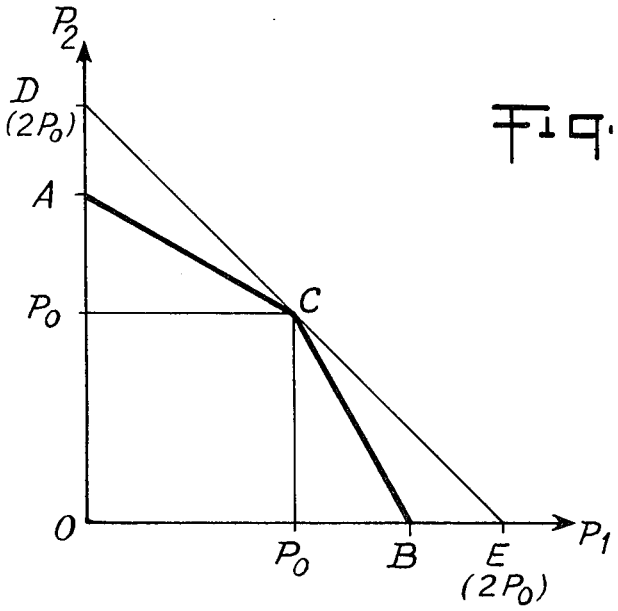
FIG. 4 the operating diagram of either of the apparatuses of FIGS. 1 and 2.

Finally, the diagram of FIG. 4 represents the pressure variation $P_2$ of the fluid contained in pipe 14 of the apparatus of FIG. 1 or in pipe 40 of the apparatus of FIG. 2 as a function of the pressure variation $P_1$ of the fluid contained in the pipe 13 of the apparatus of FIG. 1 or in the pipe 39 of the apparatus of FIG. 2. The maximum values which can be simultaneously assumed by pressures $P_1$, $P_2$ correspond to the two segments CA and CB passing through the point C for which $P_1 = P_2 = P_0$, $P_0$ being the maximum theoretically permitted pressure in continuous operation. The straight line DCE passing through points $0D = 0E = 2P_0$ represents the limitation of the maximum values of pressures $P_1$, $P_2$ if a relief valve with a single control system was used in place of the relief valve with a double control system 21.

The operation of the apparatuses described hereinbefore will now be described.

An imaginary pressure P25 will be used so as to respect equation:

$$P_{25} \times S_3 = F,$$

wherein $F$ is the restoring force transmitted by rod 25*a* in opposition to the pressure forces $P_1$, $P_2$ exerted on cross-sections $S_1$, $S_2$. Thus, $P_{25} = (P_1 + P_2)/2$.

The equation of the opposing forces acting on piston 30 results in the latter being maintained in equilibrium, whereby this equation is:

$$P_{25} \times S_3 = P_1 \times S_1 + P_2 \times S_2$$

or taking account of the above values for cross-sections $S_1$, $S_2$ and $S_3$:

$$P_{25} = (P_1 + P_2)/2.$$

Device 24 is certainly a pressure summation device because it effects the ½-sum of pressures $P_1$ and $P_2$. Thus, if device 24 of FIG. 1 constitutes a pressure summation device, that of FIG. 3 also constitutes such a device.

With reference to the pressure summation device of FIG. 3 applied to the supply apparatus of FIG. 1, at the time of opening valve 21 moving member 21*a* is balanced under the pressure forces acting on cross-sections $S_1$, $S_2$ and $S_5$ and under the opposing action of force F of spring 59*a*. The opening of the valve takes place for a pressure value in pipe 4 equal to the highest of the values of pressures $P_1$, $P_2$. Two cases can occur depending on whether $P_1$ is larger or smaller than $P_2$. In both cases, the equation for the forces acting on piston 30 and moving member 21*a* is:

in the case where $P_2$ is larger than $P_1$:

$$[S_5 \times P_2] + [S_1 \times (P_1 + P_2)] = F,$$

in the case where $P_1$ is larger than $P_2$:

$$[S_5 \times P_1] + [S_1 \times (P_1 + P_2)] = F.$$

In both cases, there is a linear relationship between $P_1$ and $P_2$ represented by the two segments CA and CB of the diagram in FIG. 4.

Actually, when $P_1 = P_2$, this common value must also be equal to $P_0$, which is the maximum permitted value in continuous operation. However, a momentary increase beyond $P_0$ is permitted for $P_1$ and/or $P_2$ without endangering the construction of the supply apparatus which is able to withstand this momentary overload provided that it is of a limited nature. On the basis of these requirements, the maximum values corresponding to segments CA and CB can be obtained. However, a calibrated valve with a single control by means of the fluid of pipe 22 would cause a variation of $P_2$ as a function of $P_1$ in accordance with the segment DCE.

Finally, the choice of the values for $S_1$, $S_2$ and $S_5$ makes it possible to regulate the pressure transfer value to the particular value desired.

As compared with the supply apparatus of FIG. 1 the supply apparatus of FIG. 2 has two separate pumps. Assuming that motors 43 and 44 are supplied with pressurized fluid, i.e. valves 41 and 42 are either in the first or third positions, it is appropriate on the one hand to summate the pressures of the fluids contained in the motor supply pipes and on the other to control the relief valve 21 by the highest of these pressures and by the pressure resulting from the said pressure summation. The pressure summation takes place in the same way as with the apparatus of FIG. 1 by connecting pipes 15 and 16 of the apparatus of FIG. 2 to pipes 39 and 40. The double control of relief valve 21 is performed by selecting the higher of pressures $P_1$ and $P_2$ of pipes 39 and 40 by means of shuttle valve 52. The branching of discharge pipe 20 to the outlet 53 of shuttle valve 52 is the final point in making the supply apparatus of FIG. 2 identical to that of FIG. 1. As the remaining members and arrangements remain unchanged, the operation of the supply apparatus of FIG. 2 is obviously identical to that of FIG. 1 described hereinbefore but more particularly with reference to FIG. 4.

As a variant the invention can be applied to the case of two pumps of variable capacity, each supplying one of the motors in closed circuit. The pressure which then has to be taken into consideration for each pump is the highest of the pressures of fluid contained in the two main pipes of the said pump. This highest pressure is once again collected by using a shuttle valve connected to the pipes of each pump. Otherwise the supply apparatus according to the invention remains unchanged.

While there has been described and illustrated the preferred embodiments of the invention, it is to be understood that these are capable of variation and modification and it is therefore not desired to be limited to the precise detail set forth but to include such modifications and alterations as fall within the scope of the appended claims.

What is claimed is:

1. A hydraulic power supply system for supplying pressurized fluid to first and second fluid operated means such as hydraulic motors, said system comprising pressurized fluid source means, a flow divider having an inlet and first and second outlets, a delivery pipe connecting said pressurized fluid source means to said inlet of said flow divider, first and second main pipes each of which is connected on one end to one of the fluid operated means and on an opposite end to one of the outlets of said flow divider, a pressure summation device having first and second inlets, a first auxiliary pipe connecting one of said main pipes to said first inlet of said pressure summation device, a second auxiliary pipe connecting the other one of said main pipes to said second inlet of said pressure summation device, a shunt discharge pipe connected on one end to said delivery pipe, a calibrated relief valve positioned in said shunt discharge pipe and including a movable valving member mounted for movement between an open position in which flow through said shunt discharge pipe is permitted and a closed position in which flow through said shunt discharge pipe is prevented, said valving member being urged toward said open position by the pressure of fluid in the portion of said discharge pipe located between the connection of the discharge pipe to the delivery pipe and the calibrated relief valve, said pressure summation device including an enclosure defining first and second cylinder sections, a double piston having first and second piston portions of different cross-sectional area, said first piston portion being mounted for reciprocation in said first cylinder section and said second piston portion being mounted for reciprocation in said second cylinder section, said first and second piston portions having faces in first and second chambers of said enclosure, said first and second inlets of said pressure summation device being connected to respective ones of said first and second chambers, wherein said double piston comprises a movable output member which exerts a force which is indicative of the sum of the pressures supplied to said first and second inlets of the pressure summation device and means mechanically connecting said double piston to said movable valving member of said relief valve for urging said movable member with progressively increasing force toward its open position as the sum of the pressures in the inlets of said pressure summation device increases.

2. A supply apparatus according to claim 1, wherein the movable valving member of said calibrated relief valve is integral with the double piston of the pressure summation device.

3. An apparatus for supplying pressurized fluid to first and second fluid operated means, said apparatus comprising first and second pressurized fluid sources, a first main pipe connected on one end to said first pressurized fluid source and connected on an opposite end to said first fluid operated means, a second main pipe connected on one end to said second pressurized fluid source and connected on an opposite end to said second fluid operated means, a pressure summation device having first and second pressure input inlets and a movable output member, a first auxiliary pipe connected on one end to said first main pipe and connected on an opposite end to said first pressure input inlet of said pressure summation device, a second auxiliary pipe connected on one end to said second main pipe and connected on an opposite end to said second pressure input inlet of said pressure summation device, connecting pipe means extending between said first main pipe and said second main pipe, shuttle valve means mounted in said connecting pipe means, said shuttle valve means having a discharge outlet, a discharge pipe connected to said discharge outlet of said shuttle valve means, a calibrated relief valve mounted in said discharge pipe, said calibrated relief valve having a movable valving member movable between an open position and in which flow through said discharge pipe is freely permitted and a closed position blocking flow through said open position by the pressure of fluid in the portion of said discharge pipe located between the outlet of said shuttle valve and said calibrated relief valve, said fluid pressure in said portion of said discharge pipe being applied to said movable valving member by a control pipe connected to said portion of said discharge pipe on one end and on an opposite end to the body of said relief valve, said pressure summation device comprising an enclosure providing first and second cylinder sections, a double piston having first and second piston portions respectively mounted in said first and second cylinder sections, said first and second piston portions having faces in first and second chambers in said enclosure, said first and second inlets of said pressure summation device being connected to respective ones of said first and second chambers and means mechanically connecting said double piston to said movable valving member of said calibrated relief valve so that the sum of the pressures in said first and second inlets of the pressure summation device results in a force exerted by said double piston which is in proportion to the sum of said pressures urging said movable valving member toward said open position.

4. The invention of claim 3, wherein said movable valving member of said relief valve is integrally formed with said double piston of said pressure summation device.

* * * * *